US009888800B2

(12) United States Patent
Mueller et al.

(10) Patent No.: US 9,888,800 B2
(45) Date of Patent: Feb. 13, 2018

(54) ROTATABLE SERVING CAROUSEL FOR OUTDOOR TABLE

(71) Applicant: Plank and Hide, Cincinnati, OH (US)

(72) Inventors: Erik Mueller, Loveland, OH (US); James Postell, Cincinnati, OH (US)

(73) Assignee: Plank and Hide, Cincinnati, OH (US)

( * ) Notice: Subject to any disclaimer, the term of this patent is extended or adjusted under 35 U.S.C. 154(b) by 0 days.

(21) Appl. No.: 15/222,216

(22) Filed: Jul. 28, 2016

(65) Prior Publication Data

US 2017/0027360 A1 Feb. 2, 2017

Related U.S. Application Data

(60) Provisional application No. 62/197,726, filed on Jul. 28, 2015.

(51) Int. Cl.

| | |
|---|---|
| ***A47B 13/00*** | (2006.01) |
| ***A47G 23/08*** | (2006.01) |
| ***A47B 13/16*** | (2006.01) |
| ***A47B 37/04*** | (2006.01) |

(52) U.S. Cl.

CPC ..... *A47G 23/08* (2013.01); *A47B 13/16* (2013.01); *A47B 37/04* (2013.01)

(58) Field of Classification Search

CPC ..... A47G 23/08; A47B 13/16; A47B 37/04; A47B 2220/0008; A47B 2220/007

USPC ... 108/42, 25, 26, 50.12, 50.11, 94–96, 139, 108/141

See application file for complete search history.

(56) References Cited

U.S. PATENT DOCUMENTS

| | | | | | |
|---|---|---|---|---|---|
| 477,987 | A | * | 6/1892 | Brandon | A47F 5/005 108/26 |
| 795,837 | A | * | 8/1905 | Hyde et al. | A47B 13/16 108/105 |
| 830,532 | A | * | 9/1906 | Rozee | A47B 31/06 108/11 |
| 1,162,290 | A | * | 11/1915 | Koken | A47B 11/00 108/94 |
| 2,520,450 | A | * | 8/1950 | Austin, Jr. | A45F 3/44 108/150 |

(Continued)

FOREIGN PATENT DOCUMENTS

| | | | |
|---|---|---|---|
| CA | 2327562 | * | 7/2001 |
| CN | 202884871 U | | 4/2013 |

(Continued)

*Primary Examiner* — Janet M Wilkens

(74) *Attorney, Agent, or Firm* — Wood Herron & Evans LLP

(57) ABSTRACT

A rotatable serving carousel is configured to provide serving elements extending from a centerpiece. Bowls or other useful items may be placed or connected with a carrier of the serving element. At least one arm extends from the second portion of the centerpiece to the carrier(s) and allows for rotation of the bowl generally horizontally over the table through the connection with the arm to the second portion. A user may manually push or pull on any portion of the serving element to rotate the bowl to a desired position relative to the table. The serving carousel may be provided with one or more serving elements and bowls, and the carousel improves access to these bowls while also lifting those elements off a tabletop surface to allow for more space efficiency in outdoor patio furniture using the serving carousel.

24 Claims, 7 Drawing Sheets

(56) References Cited

U.S. PATENT DOCUMENTS

| | | | | | |
|---|---|---|---|---|---|
| 2,569,310 | A | * | 9/1951 | Hitt | 108/147 |
| 3,089,438 | A | * | 5/1963 | Paradise | A47B 35/00 108/26 |
| 4,461,220 | A | * | 7/1984 | Wetzel | A47B 3/00 108/28 |
| 5,335,803 | A | | 8/1994 | O'Brien et al. | |
| 5,586,409 | A | | 12/1996 | Jamieson | |
| D448,551 | S | * | 10/2001 | Vong | D3/10 |
| 6,997,111 | B2 | | 2/2006 | Giegerich | |
| 7,007,813 | B2 | | 3/2006 | Yang | |
| 7,789,459 | B1 | * | 9/2010 | Rodriguez | A47B 37/04 297/158.3 |
| 8,136,458 | B1 | * | 3/2012 | Cass | D06F 53/005 108/152 |
| 8,640,894 | B1 | | 2/2014 | Cronin | |
| 2004/0129184 | A1 | * | 7/2004 | Kraker | A45B 25/00 108/50.12 |
| 2005/0034638 | A1 | * | 2/2005 | Li | A47B 37/04 108/50.12 |
| 2005/0109247 | A1 | * | 5/2005 | Nelson | A47B 37/04 108/42 |
| 2013/0239943 | A1 | | 9/2013 | James | |

FOREIGN PATENT DOCUMENTS

| | | | | |
|---|---|---|---|---|
| CN | 202919444 | U | | 5/2013 |
| DE | 29915254 | U1 | | 3/2000 |
| DE | 102007021123 | | * | 11/2008 |
| FR | 2552985 | | * | 4/1985 |
| GB | 2440499 | A | | 2/2008 |
| WO | 9951122 | | * | 10/1999 |

* cited by examiner

ROTATABLE SERVING CAROUSEL FOR OUTDOOR TABLE

CROSS-REFERENCE TO RELATED APPLICATION

This application claims priority to U.S. Provisional Application Ser. No. 62/197,726, filed Jul. 28, 2015. This prior application is incorporated herein by reference, in its entirety.

TECHNICAL FIELD

The present invention relates generally to furniture configured for use outdoors. More particularly, the present invention relates to a serving tray-like carousel for retaining bowls and other service items on a table.

BACKGROUND

Chip bowls are frequently used to hold a variety of snack food items, such as potato chips, tortilla chips, pretzels, crackers, snack mixes, and similar items. Likewise, dip bowls are frequently used to hold accompanying dips or toppings, such as salsas, cheese dips, vegetable dips, meat dips, and similar items. Chip bowls and dip bowls and other similar service items are commonly associated with social gatherings and celebrations. For example, they are often featured at swimming pool parties, graduation parties, family game nights, and any other type of celebration or gathering. Hosts of such events frequently place chip bowls, dip bowls, and other service items on tabletops so that guests may casually serve themselves.

However, tabletop space is limited. As a result, tabletops often become overcrowded during these festive events. The aforementioned chip bowls, dip bowls, and other service items may interfere with other objects on the table, such as beverages, tabletop games (board games and card games), and other food vessels. Moreover, the particular placement of the chip bowls and dip bowls is often inconvenient and may require guests to reach across the tabletop or walk around the table in order to access one of the bowls. These and other problems associated with conventional chip bowls and dip bowls can cause frustration, annoyance, and dissatisfaction among guests. The limits on tabletop space are even more pronounced in the outdoor patio furniture setting, as the existing limits on deck or patio space tend to force these tables to be smaller in size. Therefore, outdoor patio tables and other furniture often does not suffice to hold all the bowls, service items, and other things that are desired to be placed on a table in a social gathering or other similar settings.

Attempts to address some of these concerns have included the development of a "Lazy Susan" or serving tray for a table that rests upon the tabletop and allows for rotation of elements supported on the serving tray. However, this conventional type of serving tray includes a base which is configured to rest upon the tabletop and therefore continues to take up valuable space and interfere with other items on the tabletop. In this regard, although the need to pass elements around a table may be reduced with such serving tray designs, the problems with space on a tabletop in environments like family game nights or parties continue to persist.

Therefore, a need exists for a serving tray that addresses these and other concerns with conventional designs of tables and serving trays.

SUMMARY

The rotatable serving carousel and other features of the invention disclosed herein overcome the foregoing and other shortcomings and drawbacks of conventional designs. To this end, one embodiment of the rotatable serving carousel includes a centerpiece having a first portion and a second portion, the first portion being configured for securing the centerpiece in position relative to an outdoor patio table. The second portion of the centerpiece is coupled to the first portion so as to be rotatable relative to the first portion. The serving carousel also includes at least one serving element connected to the second portion of the centerpiece. The serving element includes a carrier configured to support an item which is typically supported on a tabletop surface, and further includes an arm extending between the second portion of the centerpiece and the carrier. The serving element is rotatable with the second portion about the centerpiece to provide access to the item at various positions around the table. The centerpiece and the at least one serving element are formed from a weather-resistant material such as a metal like aluminum or a plastic. The centerpiece and the at least one serving element collectively support a plurality of items at a position spaced above the tabletop. Advantageously, these items free up space for using the tabletop for other elements and purposes (enabling the tabletop to receive other elements), while improving access to the items on the serving carousel.

In some embodiments, the plurality of items includes one or more bowls, which may define different sizes, such as in a scenario where a large bowl holds chips and smaller bowl(s) hold dips and/or various varieties of snacks. The serving carousel may also include a serving platform coupled to or formed integrally with the first portion of the centerpiece. The serving platform includes a support shaft extending upwardly from the first portion and a support element provided at an opposite end of the support shaft from the first portion. For example, the support element may be defined by a generally plate-like platform element. In such embodiments, the support element may hold a bowl or other item, and the carrier on the one or more serving element(s) also may hold a bowl or other item. Therefore, multiple items are removed from the tabletop surface to free up space.

In some embodiments, the centerpiece is supported at least partially by sitting on top of the tabletop. In other embodiments, the centerpiece may define a clamp which engages with an umbrella shaft. The serving carousel also includes in some embodiments a light disposed on the carrier(s) to illuminate the tabletop surface. These and other features of the invention are described in detail below.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Referring now to FIGS. 1-4, a first embodiment of a rotatable serving carousel 10 of the present invention is installed upon a tabletop 12 (also referred to as a tabletop surface) of an outdoor table 14, which also includes a plurality of legs 13 for supporting the tabletop 12. The serving carousel 10 is designed to improve the usage of space on the tabletop 12 while also providing easier access to certain items such as chip and dip bowls supported on the serving carousel 10 to persons at all locations around the table 14. To this end, the serving carousel 10 provides a support for multiple bowls or other containers and items, which retains these items at a location above the tabletop 12, with some or all of the bowls and items being moveable around a pivot axis of rotation (typically located in the center of the table 14 but possibly located in other locations as well). As will be readily understood, the serving carousel improves the space efficiency and use of a table 14, particularly in the outdoor furniture setting where the overall size and functionality such tables and the like are typically constrained by limits of deck or patio space available.

Figure 4:
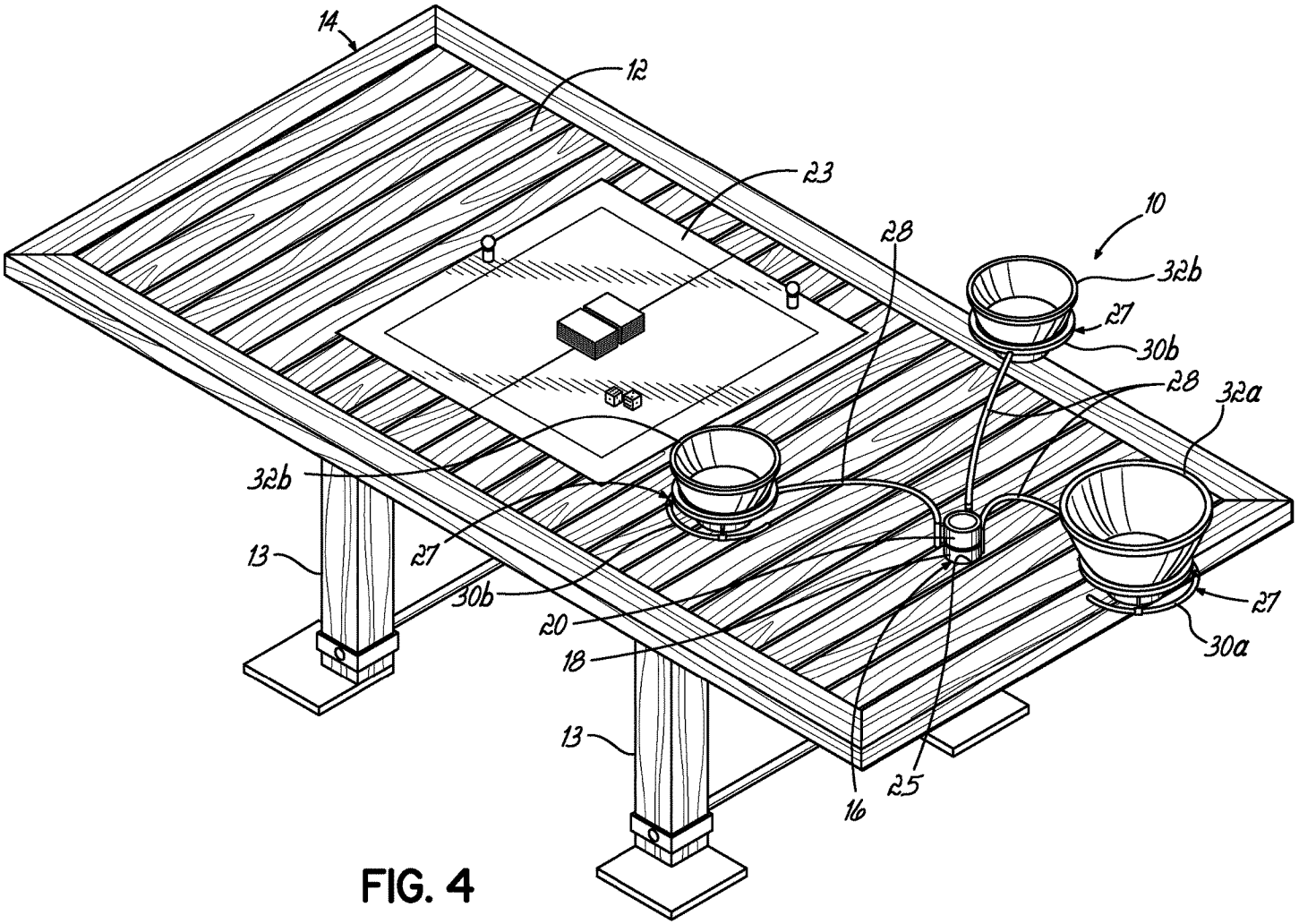
FIG. 4 is a top perspective view of the rotatable serving carousel of FIG. 1 removably connected to the table through a different aperture of the table, such as when a tabletop board or card game is covering the center of the table.

With continued reference to FIGS. 1 and 2, the serving carousel 10 of this embodiment includes a centerpiece 16 including a first portion, referred to hereinafter as a base portion 18, and a second portion, referred to hereinafter as a rotatable plug portion 20. The base portion 18 is formed in a cross-sectional T-shape and is configured to be received within a hole or aperture of the tabletop 12. For example, the base portion 18 is received within an umbrella hole 22 of the tabletop that may be otherwise provided for receiving the post or shaft 24 of an umbrella 26 (shown in phantom in FIG. 2). In this manner, the serving carousel 10 is held in a centered position on and by the table 14. Alternatively, the base portion 18 is received within a different hole or aperture of the tabletop, such as a dedicated hole 25 that may be provided primarily for use with the serving carousel 10 (FIG. 4). This configuration is advantageous for applications involving a tabletop that does not have an umbrella hole, or when a tabletop item, such as a tabletop board or card game 23, covers the umbrella hole 22, or when it is desirable to simultaneously utilize both the umbrella 26 and the serving carousel 10. To this end, the location of the serving carousel 10 relative to the table 14 may be varied in other embodiments depending on the needs of the end user, without departing from the scope of the invention.

A portion (not shown) of the rotatable plug portion 20 is received in the base portion 18 such that the plug portion 20 may be rotated relative thereto, and without tipping over or disconnection of the plug portion 20 relative to the base portion 18. For example, a plug, pin, or shaft extends downwardly from plug portion 20 into a channel/receptacle (not shown) formed in the base portion 18 to rotatably and removably connect plug portion 20 with base portion 18. The projection of plug portion 20 and the corresponding receiving channel of base portion 18 include generally smooth abutting surfaces to facilitate efficient rotation of plug portion 20 within base portion 18.

A plurality of serving elements 27 extends from the rotatable plug portion 20. Each serving element 27 includes an arm 28 connected to the plug portion 20. Arms 28 are attached to the plug portion 20 by any suitable attachment means, such as, for example, welding, over-molding, threaded engagement, gluing, or the like. Alternatively, the arms 28 and plug portion 20 may be of a unitary construction. In one embodiment, the arms 28 extend from the centerpiece 16 in a generally upward and radial (outward) direction, such that the distal ends of the arms 28 are spaced above the tabletop 12. For example, in the embodiment shown, the arms 28 extend upwardly and outwardly from the centerpiece 16 in an arcuate, arch-like or non-linear manner.

Each serving element 27 includes a carrier 30*a*, 30*b* disposed on the distal end of a particular arm 28. Carrier 30*a*, 30*b* is configured to hold a bowl 32*a*, 32*b* thereon using any suitable means. For example, as shown in FIG. 2, carrier 30*a*, 30*b* is ring-shaped, such that a bowl 32*a*, 32*b* may be positioned within a central aperture of the carrier 30*a*, 30*b* and held thereby. Alternatively, carrier 30*a*, 30*b* may be plate-shaped with or without a central recess (not shown), such that bowl 32*a*, 32*b* may securely be retained in the central recess. In some embodiments of the invention, bowls 32*a*, 32*b* may be permanently attached to the carrier 30*a*, 30*b*. However, it is also possible to have the bowls 32, 32*b* provided as separate pieces for easier storage and cleaning of the bowls 32*a*, 32*b* following use on the serving carousel 10. The carriers 30*a*, 30*b* are attached to the respective arm 28 by any suitable attachment means, such as, for example, welding, over-molding, threaded engagement, gluing, or the like. Alternatively, each carrier 30*a*, 30*b* and associated arm 28 may be of a unitary construction. The serving elements 27 are generally formed from an aluminum material in one embodiment, although other weather-resistant metallic and/or plastics materials configured for outdoor use with an outdoor patio furniture arrangement are also possible in other embodiments.

Figure 1:
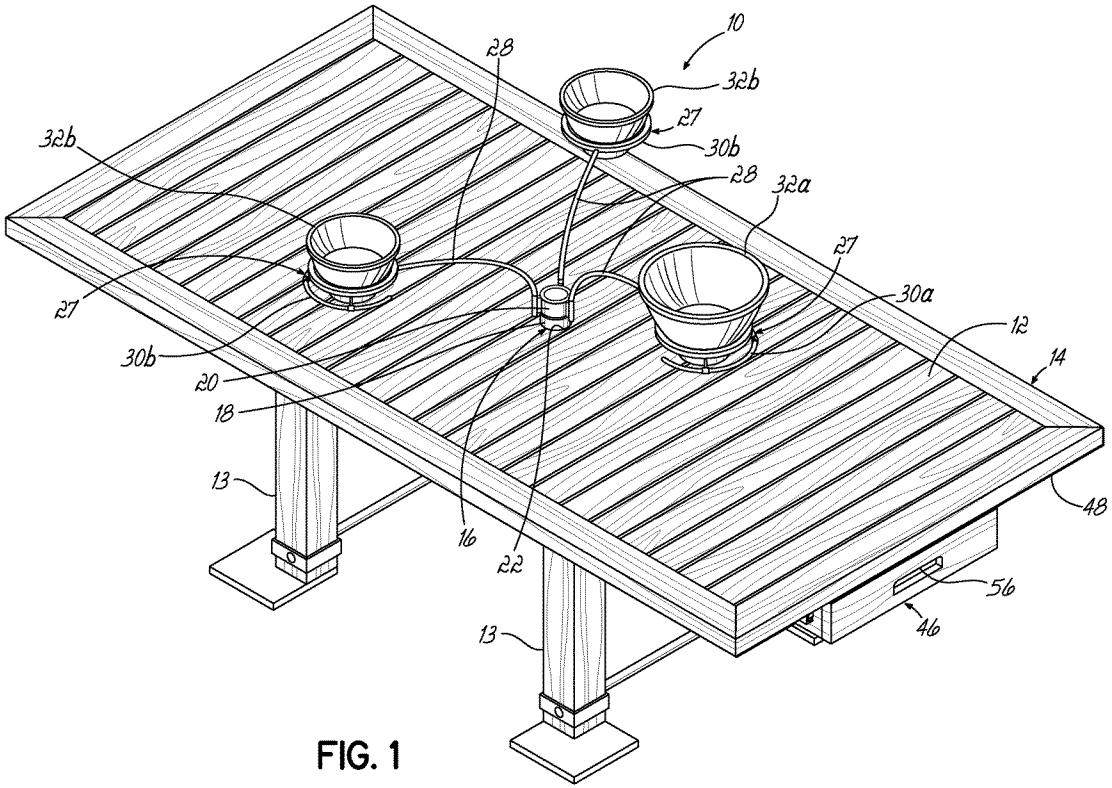
FIG. 1 is a top perspective view of a rotatable serving carousel installed upon an outdoor table, in accordance with one embodiment of the invention.

As shown in FIG. 1, each carrier 30*a*, 30*b* is of different sizes to support a variety of bowls. For example, as shown in FIG. 1, carrier 30*a* is sized larger to accommodate larger bowl 32*a*. For example, bowl 32*a* is a chip bowl. Conversely, carrier 30*b* is sized smaller to accommodate smaller bowl 32*b*. For example, bowl 32*b* is a dip bowl. As such, it will be appreciated that carriers of any size may be used in any combination to accommodate the desired bowl types. While the illustrated embodiment portrays the carriers 30*a*, 30*b* as configured to hold a bowl 32*a*, 32*b*, the carriers 30*a*, 30*b* are also configured to hold other items, such as candles, vases, or ashtrays.

Figure 2:
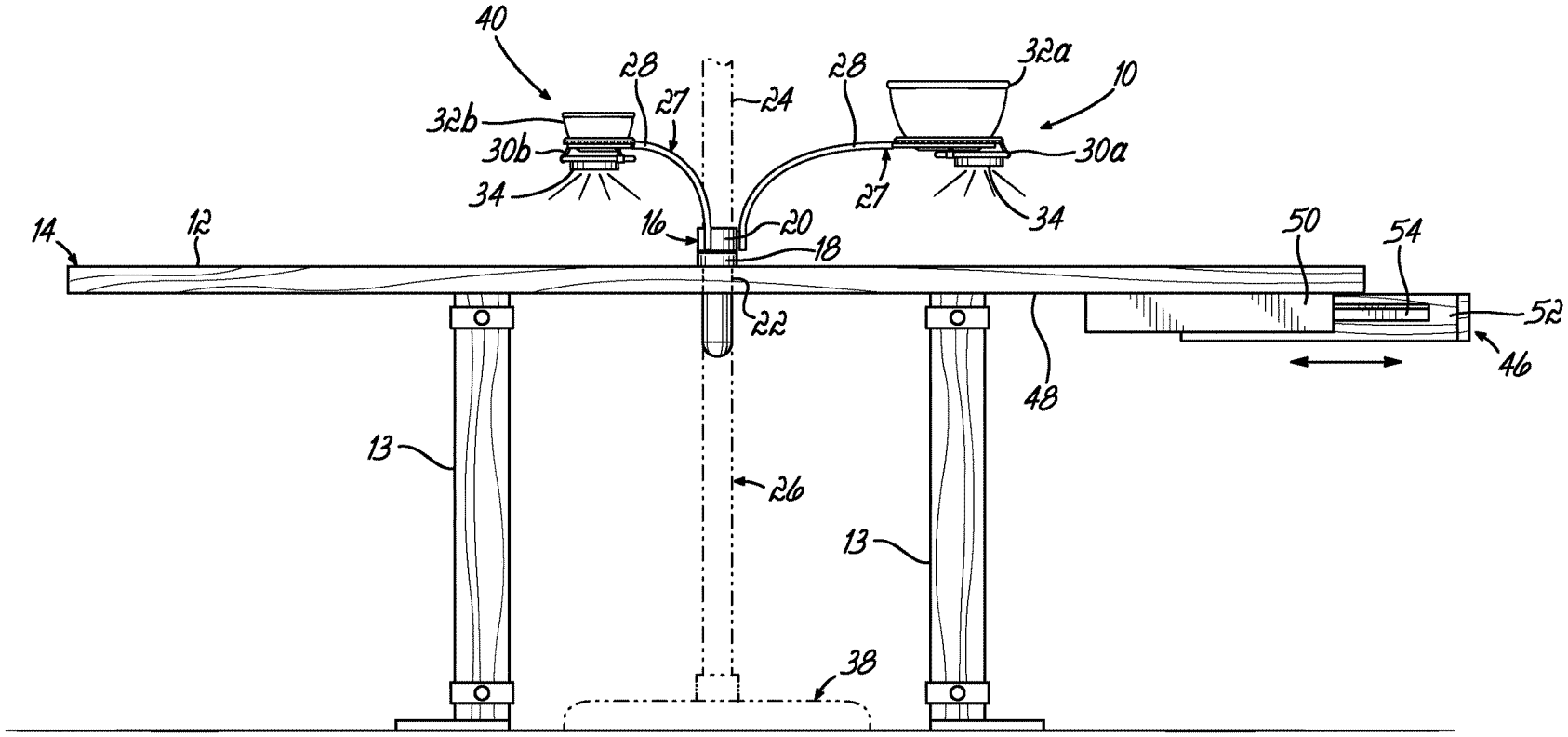
FIG. 2 is a side elevation view of the serving carousel and table of FIG. 1, with an umbrella shaft and base shown in phantom, and with the drawer system moved to an open position to reveal additional elements thereof.
Figure 3:
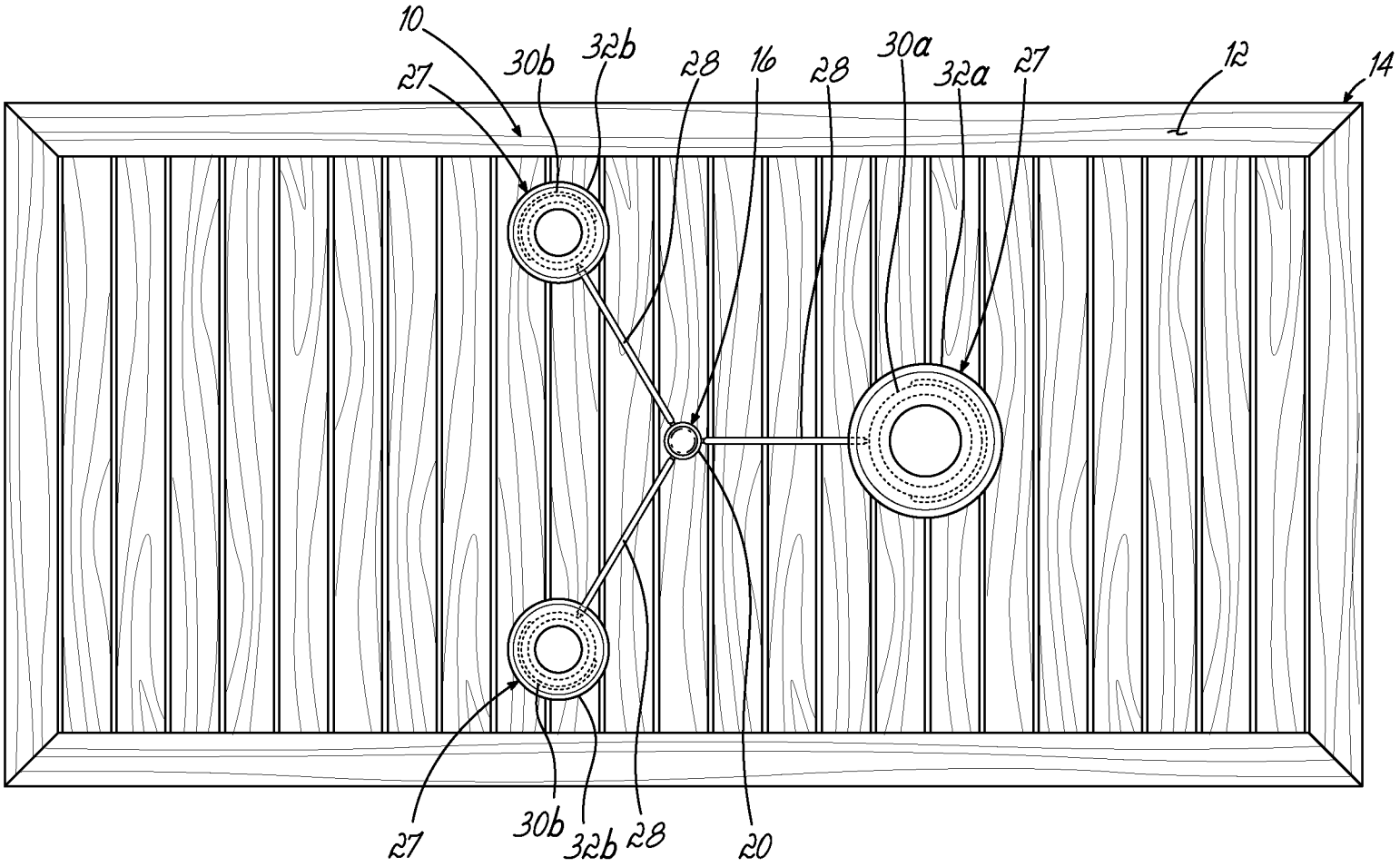
FIG. 3 is a top plan view of the serving carousel and table of FIG. 1.

As shown in FIG. 2, the rotatable plug portion 20 and serving elements 27, including arms 28 and carriers 30*a*, 30*b*, comprise a rotatable top portion 40. A person sitting or standing near the table 14 may access the bowl 32*a*, 32*b* that is proximate his or her position by simply reaching his or her hand into the bowl 32*a*, 32*b*. Alternatively, the person may manually rotate the top portion 40 in order to access an unreachable bowl 32*a*, 32*b*. For example, the person may first rotate the top portion 40 in order to access a chip bowl, such as bowl 32*a*, and may then rotate the top portion 40 again in order to access a dip bowl, such as 32*b*.

With specific reference now to FIG. 2, lighting elements, such as, for example, light emitting diodes (LEDs) 34, are provided on the underside of carrier 30*a*, 30*b*. The LEDs 34 project light in a downward direction in order to at least partially illuminate the tabletop 12. Therefore, the LEDs 34 allow a person to better see the tabletop 12 and any items thereon, such as a board game 23 (FIG. 4), in dark or dimly lit conditions, as may often occur in outdoor settings. In one embodiment, the LEDs 34 are battery-powered. Alternatively, power may be supplied to the LEDs 34 via power cables attached to, or disposed within, the arms 28 (not shown). In a further embodiment, lighting elements may be incorporated with arms 28 to allow for illumination along the entire or a partial portion of the length of arms 28.

As shown in FIG. 2, table 14 includes a drawer system 46 mounted to an underside 48 of the tabletop 12. Drawer system 46 includes a base 50 secured to the underside 48 by way of a fastener (not shown) such as a plurality of nails or screws, or it may be adhered to the underside 48 through the use of an adhesive. Drawer system 46 further includes a drawer 52 configured to be slidably mounted to the base 50. Base 50 includes a first set of rails (not shown) therein which cooperates with a second set of rails 54 secured to drawer 52. The first set of rails and the second set of rails 54 slidably cooperate to allow drawer 52 to move between a first position, generally shown in FIG. 1, and a second position, generally shown in FIG. 2. The movement of drawer 52 is achieved through manual actuation of the drawer 52 by a user. The user typically grasps a handle portion 56 defined by or provided by drawer 52. Various convenient items such as silverware or plates may be stored within drawer 52 to provide convenient access to individuals sitting at table 14 or generally proximate table 14. The drawer system 46 is shown in a closed position in FIGS. 1 and 3, and in an open position in FIG. 2.

Tabletop 12 is configured to prevent debris such as leaves and weather elements such as rain from penetrating into drawer 52. In one embodiment of drawer system 46, tabletop 12 is of a solid, one-piece construction, configured to prevent items and liquid from passing therethrough. In another embodiment, tabletop 12 is sealed to prevent debris from passing there through. In another embodiment of drawer system 46, base 50 may resemble a box with five closed sides and one open side for receiving drawer 52 therein. The top-most side prevents exposure of the contents of drawer 52 to the debris and weather elements. Drawer system 46 may also be configured with extremely tight tolerances or a gasket or sealing mechanism (not shown) between box and drawer 52 to prevent bugs or insects from accessing the contents therein. In light of the above, drawer system 46 is configured to protect the contents of drawer 52 from common outdoor unsanitary or inconvenient issues relating to the placement of drawer system 46 on an outdoor piece of furniture, such as table 14.

In as much as serving carousel 10 may be configured to be easily disassembled, drawer 52 is sized to receive the elements of serving carousel 10 therein. For example, the height of drawer 52 is configured to be greater than the depth of the centerpiece 16, all of the arms 28, the carriers 30*a*, 30*b*, and the bowls 32*a*, 32*b*. As such, the table 14 and the serving carousel 10 is provided to a customer as a kit, with the depth of the drawer 52 configured to receive the largest element of the serving carousel 10.

If the user wishes to provide dishes, silverware, plates, or other items such as candles or board games, drawer system 46 may be used to store these items. Drawer 52 is opened by the user to reveal the contents therein by way of a sliding engagement with rails 54. As set forth above, the user grasps the handle portion 56 and pulls to slide the drawer 52 along rails relative to base 50, thereby moving this between the open and closed positions as needed.

In operation, a user selects one or more bowls 32*a*, 32*b*, possibly of differing sizes, and loads the bowls 32*a*, 32*b* with the desired food. For example, as shown in FIG. 1, bowl 32*a* may receive chips, while bowls 32*b* may receive cheese dip and salsa. The user then disposes base portion 18 of centerpiece 16 of serving carousel 10 in umbrella hole 22 of table 14. As shown in FIG. 2, base portion 18 extends through hole 22 to firmly and removably connect serving carousel 10 to table 14. The user then places each bowl 32*a*, 32*b* into a corresponding carrier 30*a*, 30*b* such that the bowl 32*a*, 32*b* is held therein. As such, each bowl 32*a*, 32*b* resides upwardly away from the tabletop 12 of table 14 and this allows the user to access the entire table, save for the general area of the umbrella hole 22.

Thereafter, the user may manually manipulate the various elements of serving carousel 10 to alter the environment of table 14. For example, to better illuminate tabletop 12, the user actuates lighting elements 34 to provide downwardly directed light. If a user wishes to access a bowl 32*a*, 32*b* located across the table 14 from the user, the user may manually spin or rotate top portion 40 of serving carousel 10 to move the bowl 32*a*, 32*b* closer. For example, this action is done if a user wishes to try a different style of dip in bowl 32*b* or if the user wishes to access peanuts in a different bowl 32*b*. The rotation of top portion 40 is facilitated through the engagement (via insertion, abutment, or otherwise) of rotatable plug portion 20 with base portion 18. Conversely, if a user at another side or portion of table 14 wishes to rotate top portion 40 back, or access a different bowl 32*a*, 32*b*, the arms 28 are spaced apart in this embodiment such that no matter which orientation the serving carousel 10 is currently in, a user at any portion of table 14 may access and manually rotate the top portion 40.

Figure 5:
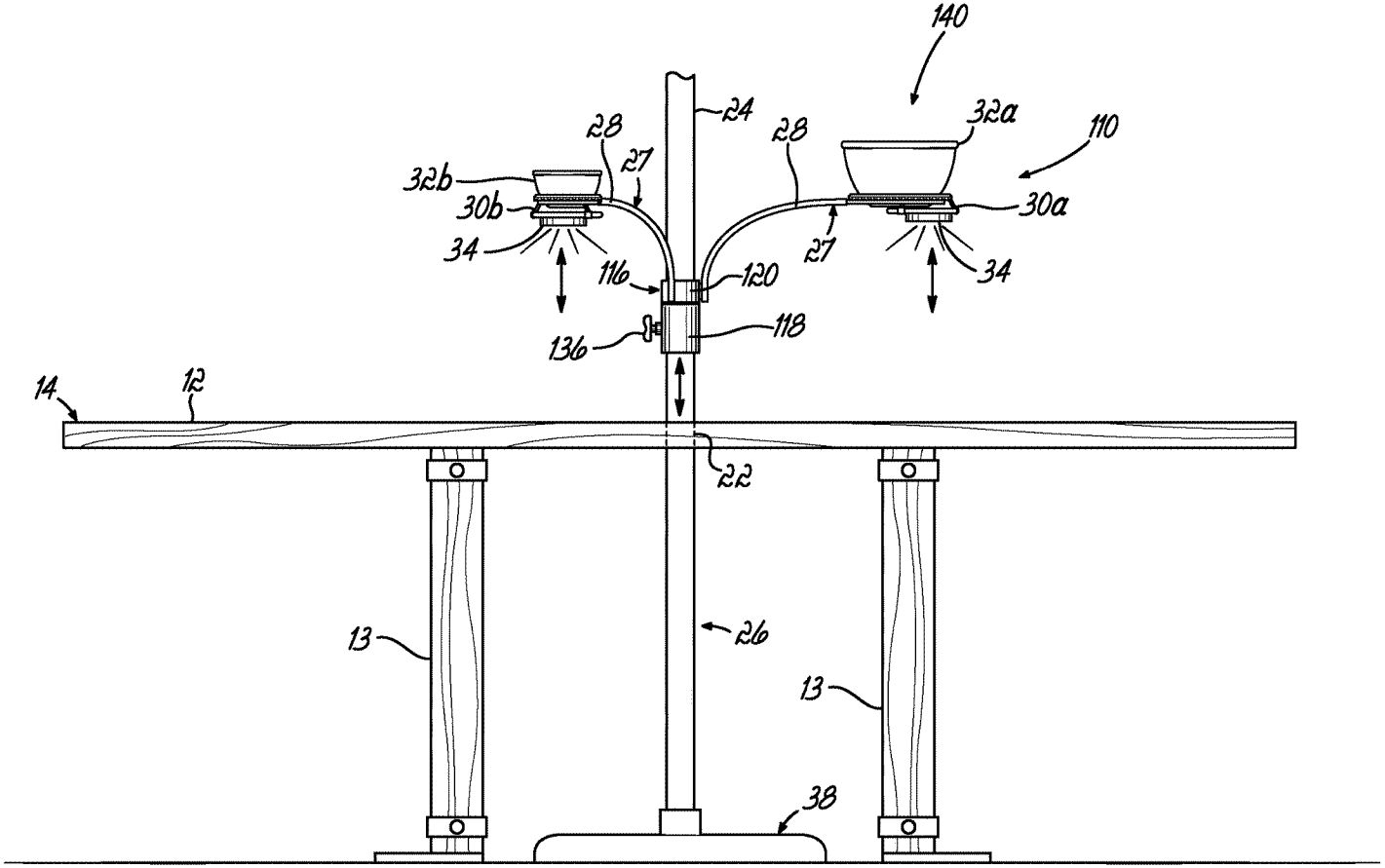
FIG. 5 is a side elevation view of another embodiment of a rotatable serving carousel of the invention, this embodiment configured to be clamped to an umbrella post as shown.

Referring now to an alternative embodiment shown in FIG. 5, a rotatable serving carousel 110 is installed over the shaft 24 of an umbrella 26. Many of the elements of this embodiment are identical or substantially similar to those described with reference to the previous embodiments above (including table legs 13), and such elements have been applied with the same reference numbers without substantive duplication of description below. To this end, the following description of the rotatable serving carousel 110 of this embodiment focuses on the distinctions of this embodiment.

The umbrella shaft 24 is received within the umbrella hole 22 of the tabletop 12 of the table 14. The rotatable serving carousel 110 includes a centerpiece 116 including a clamp portion 118 and a rotatable sleeve portion 120. The clamp portion 118 is hollow and generally cylindrically shaped so as to define an annular sleeve, and is configured to be received around the shaft 24 of the umbrella 26. Further, the clamp portion 118 includes a securing element, shown in FIG. 5 as a set screw 136, for maintaining the serving carousel 110 at a desired vertical position along the shaft 24. Other types of clamps and fasteners may be used for the securing element.

The rotatable sleeve portion 120 is also hollow and generally cylindrically shaped, and abuts the clamp portion 118 such that the sleeve portion 120 may be rotated relative thereto. The sleeve portion 120 is also configured to be received over the shaft 24. For example, a user may align the centerpiece 116 over the umbrella hole 22 and slide the shaft 24 of the umbrella 26 therethrough, until the bottom portion of the shaft 24 reaches the ground or, alternatively, an umbrella stand 38. The user may then slide the centerpiece 116 along the shaft 24 in both upward and downward vertical directions, as indicated by the arrows, until the serving carousel 110 is positioned at a desired height above the tabletop 12. The user may tighten the set screw 136 to lock the serving carousel 110 at the desired height. In this manner, both the umbrella 26 and the serving carousel 110 may be utilized at the same time, while maintaining the serving carousel 110 in a centered position. Moreover, if the height of the serving carousel 110 relative to the tabletop 12 is determined to be either too great or too small, the set screw 136 may be loosened and the serving carousel 110 may be adjusted to a more desirable height. The user may rotate a top portion 140 comprising rotatable sleeve portion 120 and the associated serving elements 27 to access any unreachable bowls 32*a*, 32*b*.

Figure 6:
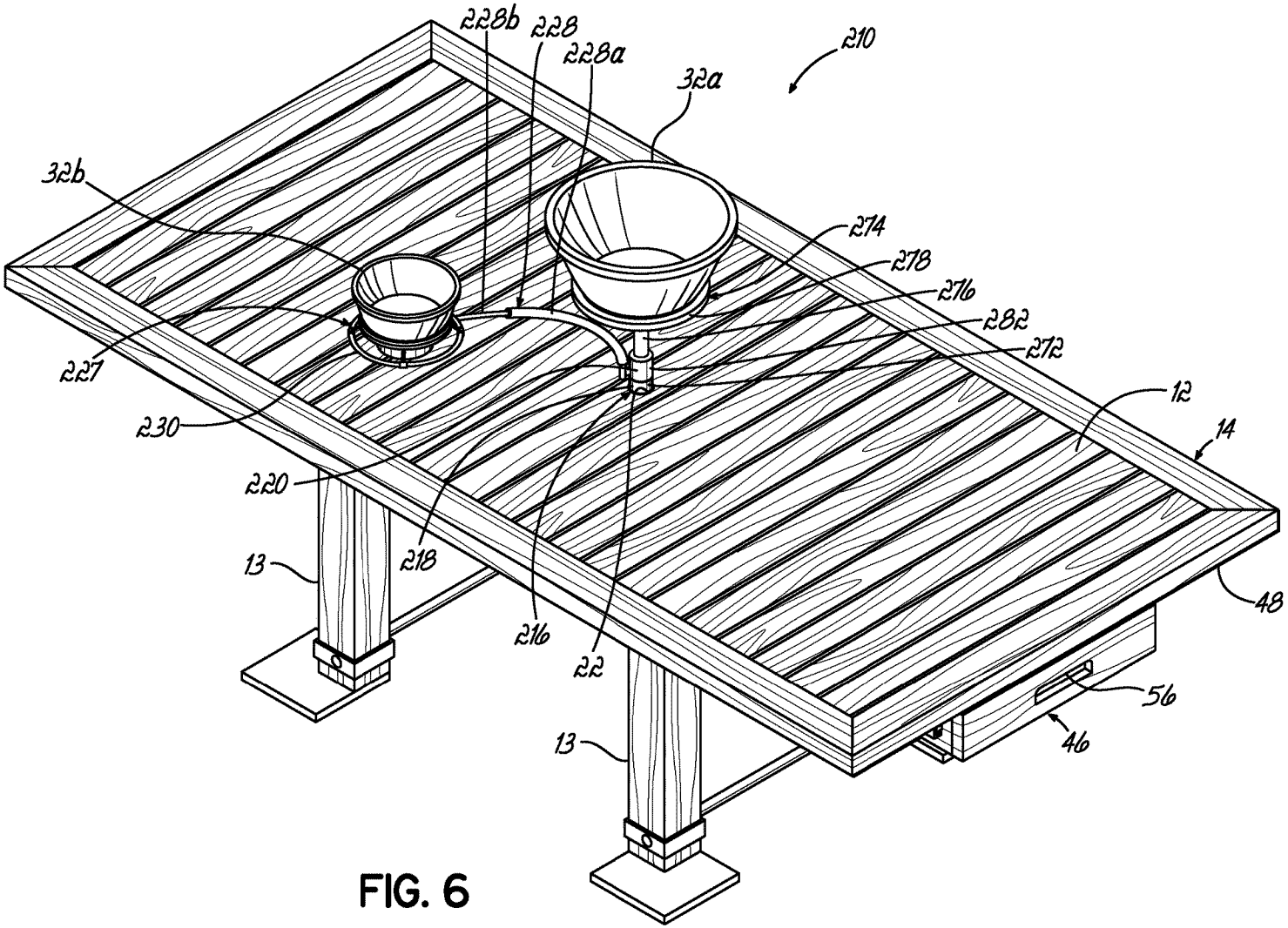
FIG. 6 is a top perspective view of another embodiment of a rotatable serving carousel according to the invention, as installed on an outdoor table, this embodiment including a central serving platform as well as at least one carrier rotatable about the central serving platform.
Figure 7:
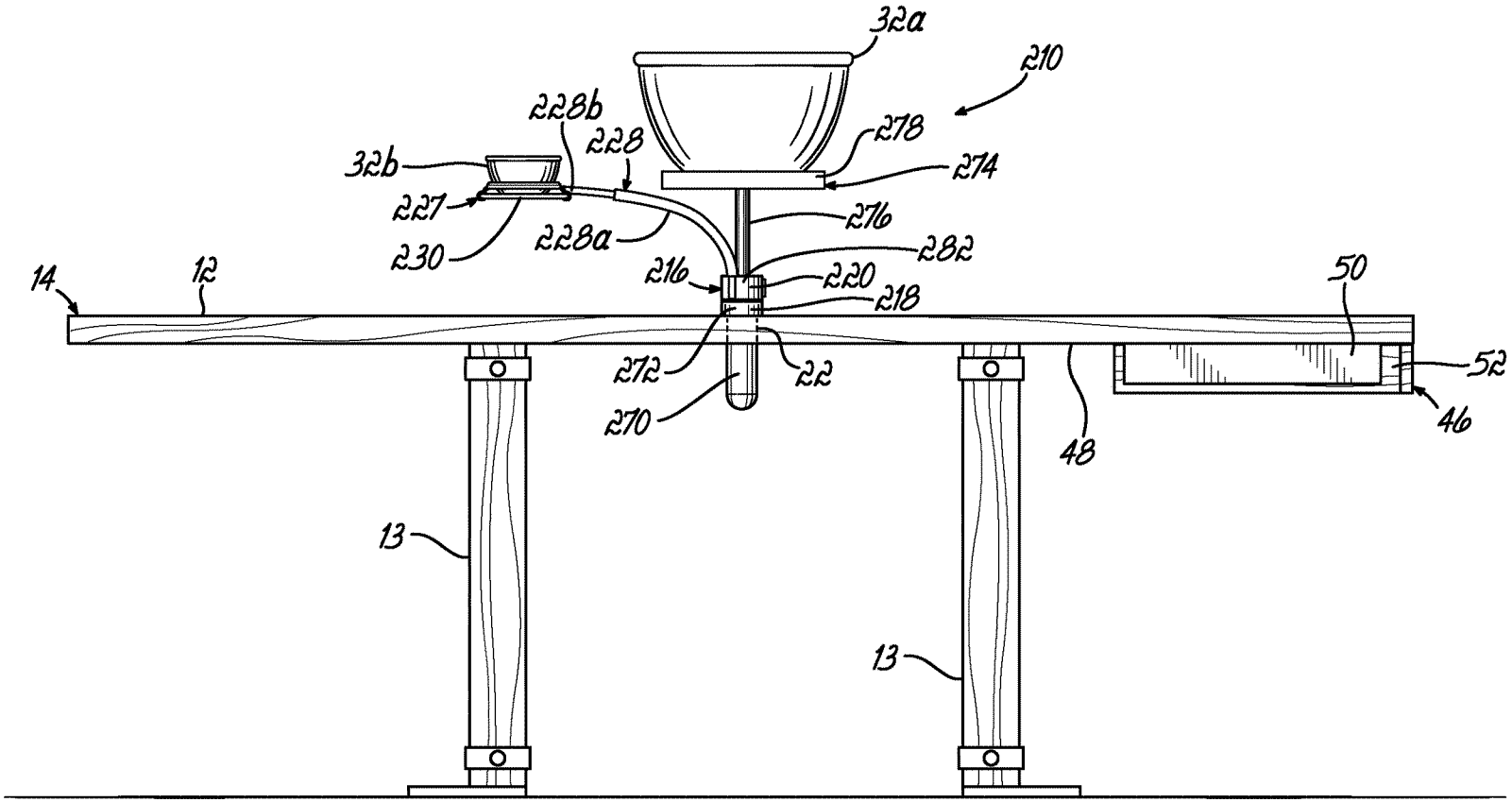
FIG. 7 is a side elevation view of the serving carousel and table of FIG. 6.

Now turning with reference to FIGS. 6 and 7, another embodiment of a rotatable serving carousel 210 for use with the tabletop 12 of a table 14 configured for outdoor use is shown in detail. Many of the elements of this embodiment are identical or substantially similar to those described with reference to the previous embodiments above (including table legs 13 and drawer system 46), and such elements have been applied with the same reference numbers without substantive duplication of description below. To this end, the following description of the rotatable serving carousel 210 of this embodiment focuses on the distinctions of this embodiment.

The serving carousel 210 of this embodiment again includes a centerpiece 216 which includes a first or base portion 218 and a second or rotatable portion 220. The base portion 218 includes a lower projecting shaft 270 sized to extend through an aperture on the table 14 such as the umbrella hole 22 (see FIG. 7), this lower projecting shaft 270 configured to keep the serving carousel 210 secured to the table 14 without tipping over. It will be understood that in other embodiments, one or more apertures for receiving the lower projecting shaft 270 may be provided at other locations of the table 14 as previously described in FIG. 4 or otherwise (left and right side holes, for example). Moreover, in such embodiments the lower projecting shaft 270 may take a slightly modified form to match the aperture, such as being smaller in cross section, e.g., similar to or a continuation of the support shaft 276 described in further detail below. Likewise, a locking mechanism (not shown) may be provided to connect to the portion of the lower projecting shaft 270 extending through the aperture to further assure that the lower projecting shaft 270 and the base portion 218 remain engaged with the table 14.

The base portion 218 also includes a central ring-shaped base 272 which is larger in cross-sectional size than the lower projecting shaft 270 such that the central ring-shaped base 272 sits atop the tabletop 12 when the serving carousel 210 is installed on the outdoor furniture. A central serving platform 274 is coupled to or formed integrally with the base portion 218 and includes a support shaft 276 extending upwardly from the central ring-shaped base 272 and a support element 278 provided at an upper or opposite end of the support shaft 276 from the central ring-shaped base 272. It will be understood that the lower projecting shaft 270, the central ring-shaped base 272, and the support shaft 276 may be formed as hollow elements or as solid elements in various embodiments.

The support element 278 is shown as a generally plate-like platform element in these Figures, but carriers 30*a*, 30*b* from the previous embodiment or other bowl/service item holding elements may be substituted as the support element 278 without departing from the scope of the invention. The support element 278 is configured to receive a large bowl 32*a* which could hold chips, apples, or any type of food or service item as shown, this large bowl 32*a* being conveniently located in a central position accessible to everyone sitting at the table 14 but raised off of the tabletop 12 to avoid limiting space at that location.

The rotatable portion 220 in this embodiment of the serving carousel includes an annular support base 282 with at least one serving element 227 projecting radially outwardly and upwardly from the support base 282. The annular support base 282 is sized with a central aperture (not shown) configured to closely receive the support shaft 276, and these elements have corresponding smooth or lubricated surfaces facing one another so that the support base 282 and the serving element(s) 227 can rotate about the axis of rotation defined through the base portion 218. The one serving element 227 shown in FIGS. 6 and 7 again includes a carrier element 230 and an arm 228 which extends in an arc-like manner between the carrier element 230 and an outer periphery of the support base 282. In this embodiment, the serving carousel 210 consists of only one serving element 227. The arm 228 may be integrally formed with or coupled (by adherence, welding, and the like) to these other elements. The carrier element 230 of this embodiment is a double-ring structure (the two rings connected by side struts, e.g., a ring-shaped support) defining a central aperture which can receive a lower projecting portion of a small bowl 32*b* or similar element. Modifications to the carrier element 230 may be provided to support different types of elements which may need to be accessed when using the table 14.

The arm 228 of this embodiment may also include a telescoping function in one option. To this end, the arm 228 is defined by a hollow receptacle portion 228*a* extending from the support base 282 and a rod-like portion 228*b* extending from the carrier element 230. The rod-like portion 228*b* may be adjustably slid into and out of the hollow receptacle portion 228*a* to adjust how far the carrier element 230 is disposed relative to the centerpiece 216. The rod-like portion 228*b* and the hollow receptacle portion 228*a* may include any known type of securing or clamping mechanism to lock these two elements in position relative to one another when the carrier element 230 is located in a desired position.

In operation, the rotatable serving carousel 210 functions in a similar manner as the previous embodiments when used with the table 14, such as by allowing users to rotate the one or more serving elements 227 around the table 14 to provide easy access to the small bowl 32*b* as well as the larger bowl 32*a* located in the center at the support element 278. Also as with previous embodiments, the rotatable serving carousel 210 is formed from a weather-resistant material configured for outdoor use, including metallic materials like aluminum in one example (and rigid plastics in another example).

The serving carousel 10, 110, 210 and table 14 collectively improve the amount of space that may be used on the tabletop 12 while also providing access to chip and dip bowls or other elements (such as bowls that contain game cards or board game components, in another example) to persons at all sides of the table 14 without negatively impacting the space that can be used on the tabletop 12 itself for a game board, food plates, and/or other elements. To this end, lifting bowls or other service items off the tabletop 12 and providing them on the rotatable serving carousel 10, 110, 210 improves the functionality of outdoor tables and similar furniture, thereby overcoming the drawbacks associated with such furniture in large social gatherings and similar settings.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. Further, features that are described and/or illustrated with respect to one embodiment may be used in the same way or in a similar way in one or more other embodiments and/or in combination with or instead of the features of the other embodiments. This has been a description of the present invention, along with the preferred methods of practicing the present invention as currently known. However, the invention itself should only be defined by the appended claims.

What is claimed is:

1. A serving carousel configured for use with an outdoor patio table defining a tabletop, the serving carousel comprising:

a centerpiece having a first portion and a second portion, the second portion being coupled to the first portion so as to be rotatable relative to the first portion, the first portion configured for securing the centerpiece in position relative to the outdoor patio table; and at least one serving element connected to the second portion of the centerpiece, with each of the at least one serving element including a carrier configured to support an item that is typically supported on the tabletop, and further including an arm extending between the second portion of the centerpiece and the carrier, the at least one serving element being rotatable with the second portion about the centerpiece to provide access to the item at various positions around the outdoor patio table, wherein the arm of each of the at least one serving element is non-linear, the centerpiece and the at least one serving element being formed from a weather-resistant material, and wherein the centerpiece and the at least one serving element collectively support a plurality of items at a position spaced above the tabletop, thereby enabling the tabletop to receive other elements.

2. The serving carousel of claim 1, wherein the plurality of items further comprises:

a bowl, wherein the bowl is sized to be removably received into the carrier of one of the at least one serving element.

3. The serving carousel of claim 2, wherein the plurality of items is defined by a plurality of bowls, with the plurality of bowls defining at least two different sizes.

4. The serving carousel of claim 1, further comprising:

a serving platform coupled to or formed integrally with the first portion of the centerpiece, the serving platform including a support shaft extending upwardly from the first portion and a support element provided at an opposite end of the support shaft from the first portion, the support element configured to support an item that is typically supported on the tabletop.

5. The serving carousel of claim 4, wherein the support element of the serving platform is defined by a platform element.

6. The serving carousel of claim 4, wherein the at least one serving element is defined by only one serving element.

7. The serving carousel of claim 1, wherein the at least one serving element is defined by a plurality of serving elements extending in different radial directions relative to an axis of rotation defined through the centerpiece.

8. The serving carousel of claim 7, wherein the carrier of each of the plurality of serving elements includes a ring-shaped support defining a central aperture sized to receive a bowl.

9. The serving carousel of claim 1, further comprising:

a light, wherein the light is battery-powered and disposed on the carrier of one of the at least one serving element for illuminating the tabletop of the table.

10. The serving carousel of claim 1, wherein the arm of each of the at least one serving element extends in an arcuate manner upwardly and outwardly from the second portion of the centerpiece.

11. The serving carousel of claim 1, wherein the arm of each of the at least one serving element further comprises:

a hollow receptacle portion extending from the second portion of the centerpiece; and a rod portion extending from the carrier, with the rod portion being adjustably slid into and out of the hollow receptacle portion to adjust the position of the carrier relative to the centerpiece.

12. A serving carousel configured for use with an outdoor patio table defining a tabletop, the serving carousel comprising:

a centerpiece having a first portion and a second portion, the second portion being coupled to the first portion so as to be rotatable relative to the first portion, the first portion configured for securing the centerpiece in position relative to the outdoor patio table; and at least one serving element connected to the second portion of the centerpiece, with each of the at least one serving element including a carrier configured to support an item that is typically supported on the tabletop, and further including an arm extending between the second portion of the centerpiece and the carrier, the at least one serving element being rotatable with the second portion about the centerpiece to provide access to the item at various positions around the outdoor patio table, the centerpiece and the at least one serving element being formed from a weather-resistant material, wherein the centerpiece and the at least one serving element collectively support a plurality of items at a position spaced above the tabletop, thereby enabling the tabletop to receive other elements, and wherein the first portion is formed in a cross-sectional T-shape and further comprises:

a lower projecting shaft sized to extend through an aperture on the outdoor patio table; and a central ring-shaped base which is larger in cross-sectional size than the lower projecting shaft such that the central ring-shaped base is configured to sit atop the tabletop.

13. The serving carousel of claim 12, wherein the plurality of items further comprises:

a bowl, wherein the bowl is sized to be removably received into the carrier of one of the at least one serving element.

14. The serving carousel of claim 12, further comprising:

a serving platform coupled to or formed integrally with the first portion of the centerpiece, the serving platform including a support shaft extending upwardly from the first portion and a support element provided at an opposite end of the support shaft from the first portion, the support element configured to support an item that is typically supported on the tabletop.

15. The serving carousel of claim 12, wherein the at least one serving element is defined by a plurality of serving elements extending in different radial directions relative to an axis of rotation defined through the centerpiece.

16. A serving carousel configured for use with an outdoor patio table defining a tabletop, the serving carousel comprising:

a centerpiece having a first portion and a second portion, the second portion being coupled to the first portion so as to be rotatable relative to the first portion, the first portion configured for securing the centerpiece in position relative to the outdoor patio table; and at least one serving element connected to the second portion of the centerpiece, with each of the at least one serving element including a carrier configured to support an item that is typically supported on the tabletop, and further including an arm extending between the second portion of the centerpiece and the carrier, the at least one serving element being rotatable with the second portion about the centerpiece to provide access to the item at various positions around the outdoor patio table, the centerpiece and the at least one serving element being formed from a weather-resistant material, wherein the centerpiece and the at least one serving element collectively support a plurality of items at a position spaced above the tabletop, thereby enabling the tabletop to receive other elements, and wherein the first portion includes an annular sleeve configured to slide along an umbrella shaft of an umbrella associated with the outdoor patio table, and the first portion also includes a securing element coupled to the annular sleeve and operable to lock the annular sleeve in position at a desired portion of the umbrella shaft.

17. The serving carousel of claim 16, wherein the securing element includes a set screw.

18. The serving carousel of claim 16, wherein the plurality of items further comprises:

a bowl, wherein the bowl is sized to be removably received into the carrier of one of the at least one serving element.

19. The serving carousel of claim 16, further comprising:

a serving platform coupled to or formed integrally with the first portion of the centerpiece, the serving platform including a support shaft extending upwardly from the first portion and a support element provided at an opposite end of the support shaft from the first portion, the support element configured to support an item that is typically supported on the tabletop.

20. The serving carousel of claim 16, wherein the at least one serving element is defined by a plurality of serving elements extending in different radial directions relative to an axis of rotation defined through the centerpiece.

21. An outdoor patio table, comprising:

a tabletop supported by a plurality of legs;

an aperture defined by the tabletop; and a serving carousel comprising:

a centerpiece having a first portion and a second portion, the second portion being coupled to the first portion so as to be rotatable relative to the first portion, the first portion configured for securing the centerpiece in position relative to the outdoor patio table; and at least one serving element connected to the second portion of the centerpiece, with each of the at least one serving element including a carrier configured to support an item that is typically supported on the tabletop, and further including an arm extending between the second portion of the centerpiece and the carrier, the at least one serving element being rotatable with the second portion about the centerpiece to provide access to the item at various positions around the outdoor patio table, the centerpiece and the at least one serving element being formed from a weather-resistant material, wherein the centerpiece and the at least one serving element collectively support a plurality of items at a position spaced above the tabletop, thereby enabling the tabletop to receive other elements, and wherein the first portion of the centerpiece of the serving carousel engages with the aperture to secure the serving carousel in position relative to the tabletop.

22. The outdoor patio table of claim 21, further comprising:

a drawer slideably connected to the tabletop at a bottom side thereof, wherein the drawer is sized to selectively receive the serving carousel therein, wherein the tabletop prevents liquid from passing therethrough and into the drawer.

23. The outdoor patio table of claim 21, further comprising:

a plurality of bowls supported above the tabletop by the serving carousel.

24. A serving carousel configured for use with an outdoor patio table defining a tabletop, the serving carousel comprising:

a centerpiece having a first portion and a second portion, the second portion being coupled to the first portion so as to be rotatable relative to the first portion, the first portion configured for securing the centerpiece in position relative to the outdoor patio table;

a serving platform coupled to or formed integrally with the first portion of the centerpiece, the serving platform including a support shaft extending upwardly from the first portion and a generally plate-like platform element provided at an opposite end of the support shaft from the first portion, the platform element configured to support an item that is typically supported on the tabletop; and a serving element connected to the second portion of the centerpiece, with the serving element including a carrier configured to support an item that is typically supported on the tabletop, and further including an arm extending in an arcuate manner upwardly and outwardly from the second portion of the centerpiece towards the carrier, the serving element being rotatable with the second portion about the centerpiece to provide access to the item at various positions around the outdoor patio table, and the carrier including a ring-shaped support defining a central aperture sized to receive a bowl, the centerpiece and the serving element being formed from a weather-resistant material, wherein the serving carousel includes only one serving element, and wherein the centerpiece and the serving element collectively support a plurality of items at a position spaced above the tabletop, thereby enabling the tabletop to receive other elements.

* * * * *